US008002012B2

(12) United States Patent
Cheng

(10) Patent No.: US 8,002,012 B2
(45) Date of Patent: Aug. 23, 2011

(54) VENETIAN BLIND

(76) Inventor: Li-Ming Cheng, Kaohsiung (TW)

( * ) Notice: Subject to any disclaimer, the term of this patent is extended or adjusted under 35 U.S.C. 154(b) by 0 days.

(21) Appl. No.: 12/422,309

(22) Filed: Apr. 13, 2009

(65) Prior Publication Data

US 2010/0258253 A1 Oct. 14, 2010

(51) Int. Cl.
*E06B 9/322* (2006.01)
*E06B 9/30* (2006.01)
*E06B 9/307* (2006.01)

(52) U.S. Cl. ..... 160/170; 160/173 R; 160/176.1 R; 160/177 R

(58) Field of Classification Search ..... 160/170, 160/171, 168.1 R, 84.04, 84.05, 169 R, 173 R, 160/176.1 R, 177 R
See application file for complete search history.

(56) References Cited

U.S. PATENT DOCUMENTS 5,293,921 A * 3/1994 Marocco ..... 160/176.1 R
6,089,303 A * 7/2000 Metcalf et al. ..... 160/176.1 R
6,293,330 B1 * 9/2001 Ciuca ..... 160/176.1 R
6,298,897 B1 * 10/2001 Metcalf et al. ..... 160/177 R
7,281,563 B2 * 10/2007 Wu ..... 160/170
7,802,608 B2 * 9/2010 Anderson et al. ..... 160/170

* cited by examiner

*Primary Examiner* — Blair M Johnson
*Assistant Examiner* — Jaime F Cárdenas-Garcia
(74) *Attorney, Agent, or Firm* — Muncy, Geissler, Olds & Lowe, PLLC

(57) ABSTRACT

A Venetian blind includes an upper rail, a lower rail, a slat assembly, an automatic retraction means and a slat opened/closed control means equipped with an adjustment member. The automatic retraction means is installed on one side of the upper rail which has a first cord wheel set and a second cord wheel set near two sides to direct a first lift cord and a second lift cord. The automatic retraction means has a retaining set to pivotally couple a transmission set inside that has a first transmission wheel and a second transmission wheel. The first transmission wheel and second transmission wheel are linked by an elastic element which provides an elastic force to drive the transmission set. The second transmission wheel controls the slat opened/closed control means. When the lower rail is pulled downwards or pushed upwards, the slat assembly can be opened or closed at different angles.

20 Claims, 21 Drawing Sheets

VENETIAN BLIND

FIELD OF THE INVENTION

The present invention relates to a Venetian blind and particularly to a Venetian blind that has an adjustment member in a slat opened/closed control means turnable forwards and reverse and also latchable in an anchor condition to facilitate retracting and extending operations of a slat assembly and controlling opened and closed angles of the slat assembly.

BACKGROUND OF THE INVENTION

There are a wide variety of window coverings on the market. Venetian blind 10 (referring to FIG. 1) is one commonly used. It is installed mainly on a door or window to block sunshine and serve ornamental purpose. Depending on users'0 different requirements, the slat assembly 12 of the conventional Venetian blind 10 can be retracted and extended by pulling a lift cord or bead chain, or turned by turning a rotary rod 11. The lift cord or bead chain has the risk of incidentally strangling children and pets. The rotary rod 11 is not aesthetic appealing. It also has different operation approaches for lifting, lowering and turning the slats, hence is more cumbersome to use. All the conventional techniques cannot provide the benefits of a cordless blind.

SUMMARY OF THE INVENTION

Therefore, the primary object of the present invention is to provide a Venetian blind to resolve the drawbacks of the conventional Venetian blind such as not effective control of retraction, extension or turning of a slat assembly through the lift cord, bead chain or rotary rod. The invention aims to realize the benefit of a cordless blind. It has an adjustment member on a slat opened/closed control means to control forward and reverse turning and latching to facilitate retracting, extending and turning operations of slats in a simple and consistent manner, and open and close the slat assembly easier.

To achieve the foregoing object, the Venetian blind according to the invention includes an upper rail, a lower rail, a slat assembly, an automatic retraction means and a slat opened/closed control means equipped with an adjustment member. The automatic retraction means is installed on one side inside the upper rail which has a first cord directing set and a second cord directing set at two sides to direct a first lift cord and a second lift cord. The automatic retraction means has a retaining set to pivotally couple a transmission set inside. The transmission set has an elastic element with two ends respectively coupling with a first transmission wheel and a second transmission wheel. The second transmission wheel drives the slat opened/closed control means.

The transmission set pivotally coupled inside the retaining set, in addition to the first transmission wheel, second transmission wheel and elastic element, also has a reel set with a second bevel gear attached thereon engageable with a first bevel gear of the slat opened/closed control means. The elastic element is an S-shaped elastic reed with two ends respectively coupling with the first and second transmission wheels.

The slat opened/closed control means is located in the upper rail, and is engaged with the reel set and the transmission set. The slat opened/closed control means includes a transmission wheel, the adjustment member coupling on an upper side of the transmission wheel, the first bevel gear fastened to the adjustment member and a shaft portion.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
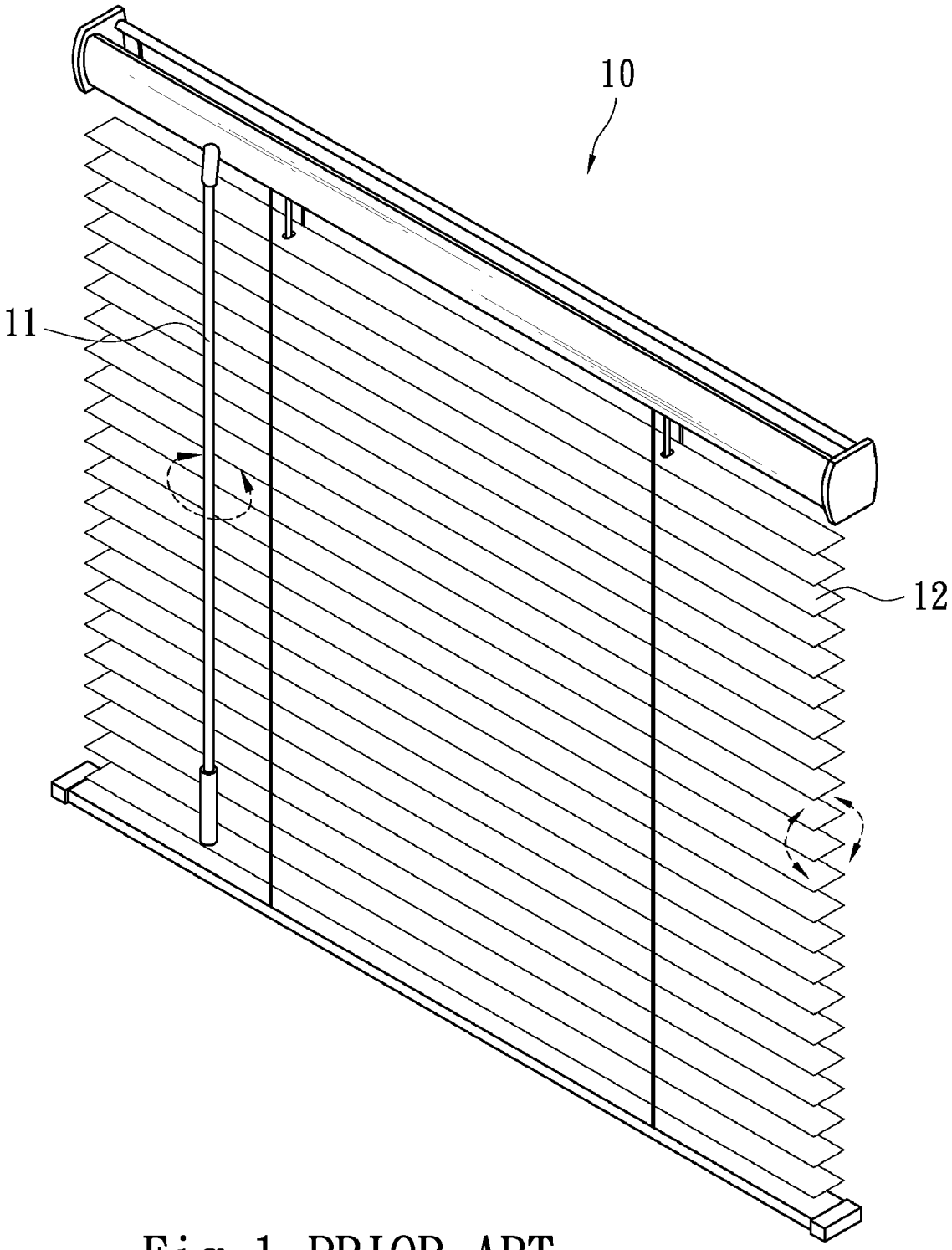
Fig. 1 PRIOR ART
FIG. 1 is a perspective view of a conventional Venetian blind.
Figure 2:
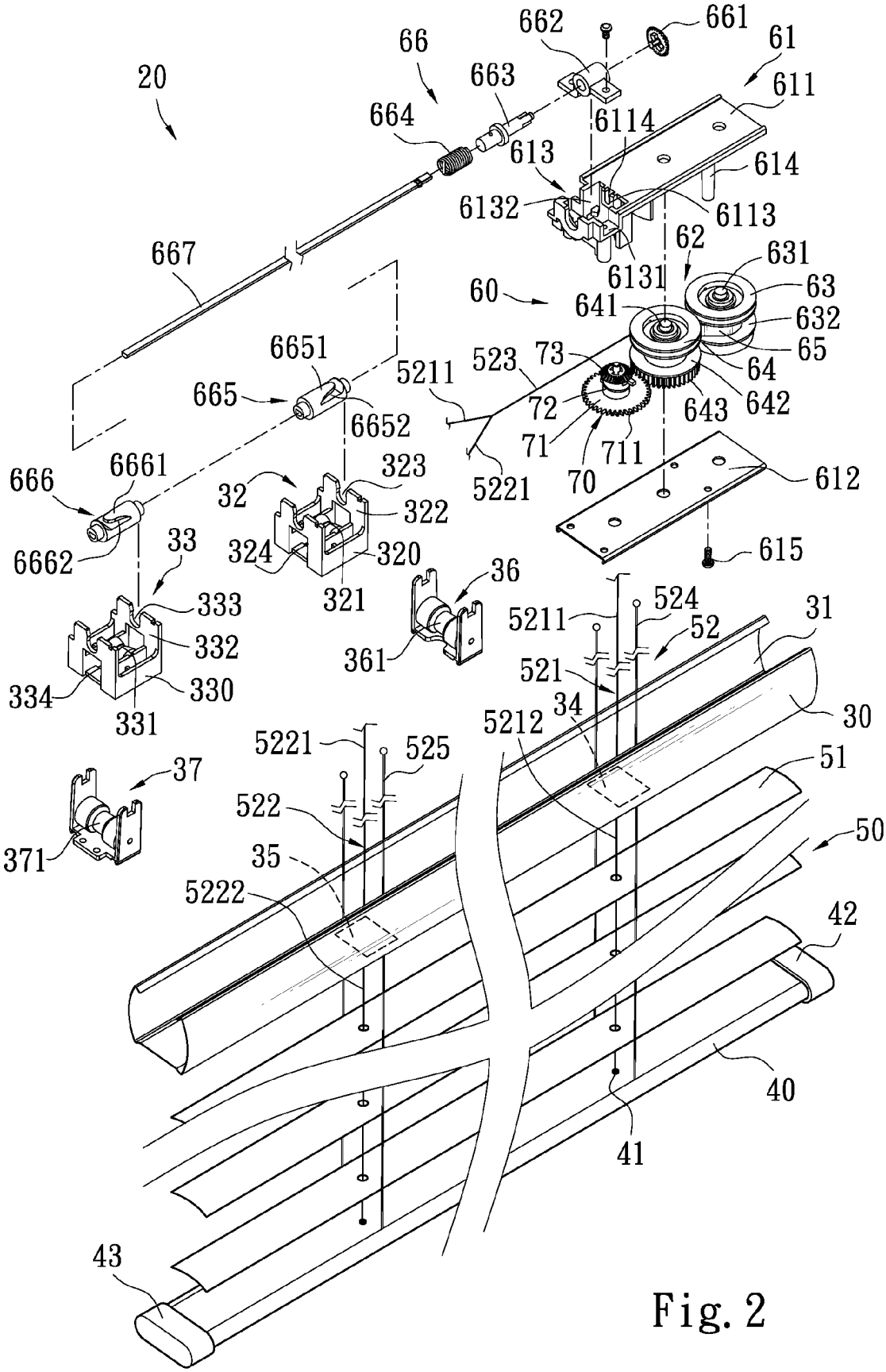
FIG. 2 is an exploded view of the Venetian blind of the invention.
Figure 3:
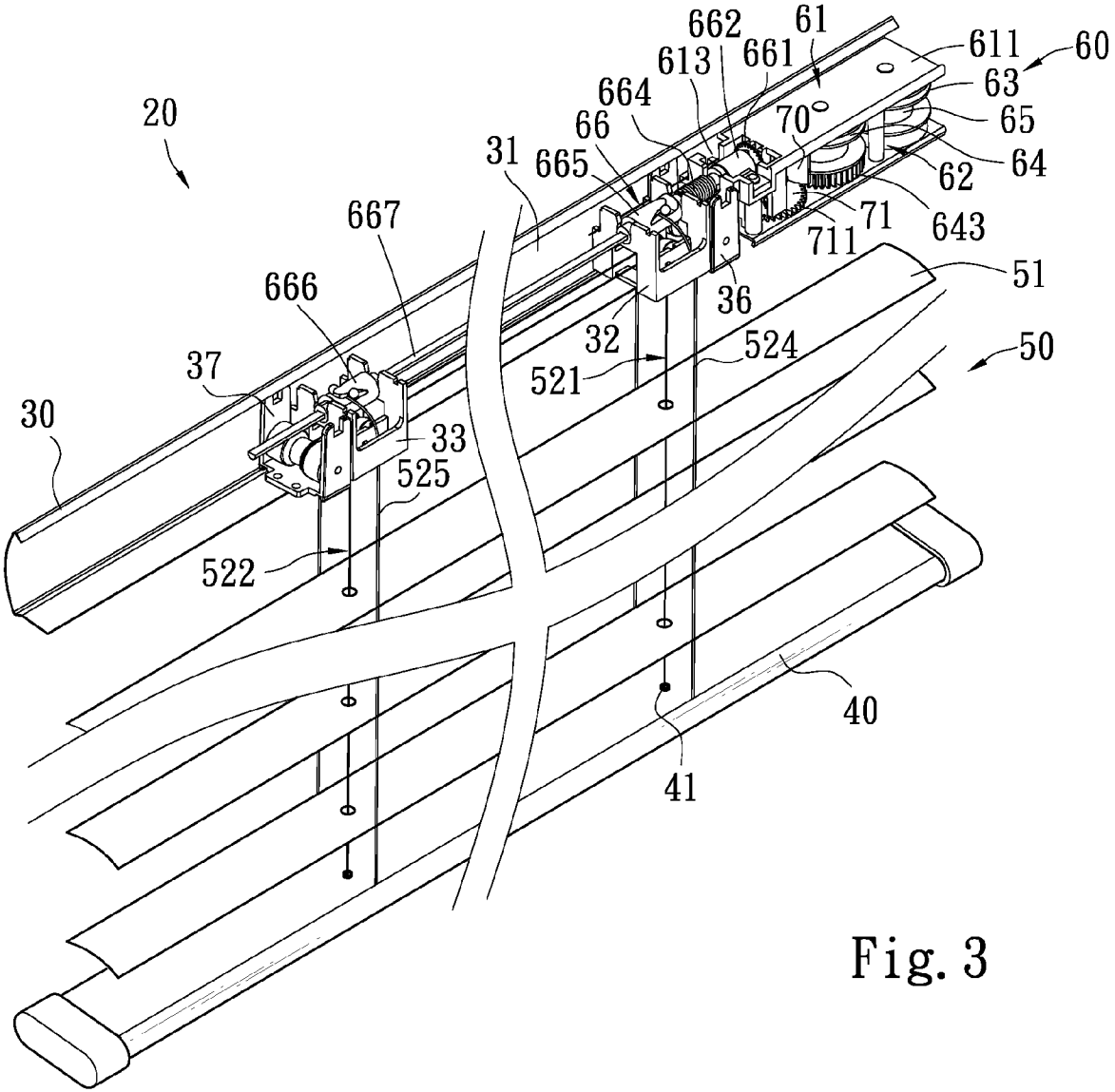
FIG. 3 is a fragmentary perspective view of the invention, partly cutaway.

Please refer to FIGS. 2 and 3, the invention provides a Venetian blind 20 which includes an upper rail 30 shaped in an elongate manner with a holding trough 31 formed therein, a lower rail 40 spaced from the upper rail 30 at a lower side, a slat assembly 50 interposed between the upper rail 30 and the lower rail 40, an automatic retraction means 60 and a slat opened/closed control means 70 located in the holding trough 31 of the upper rail 30.

Figure 4:
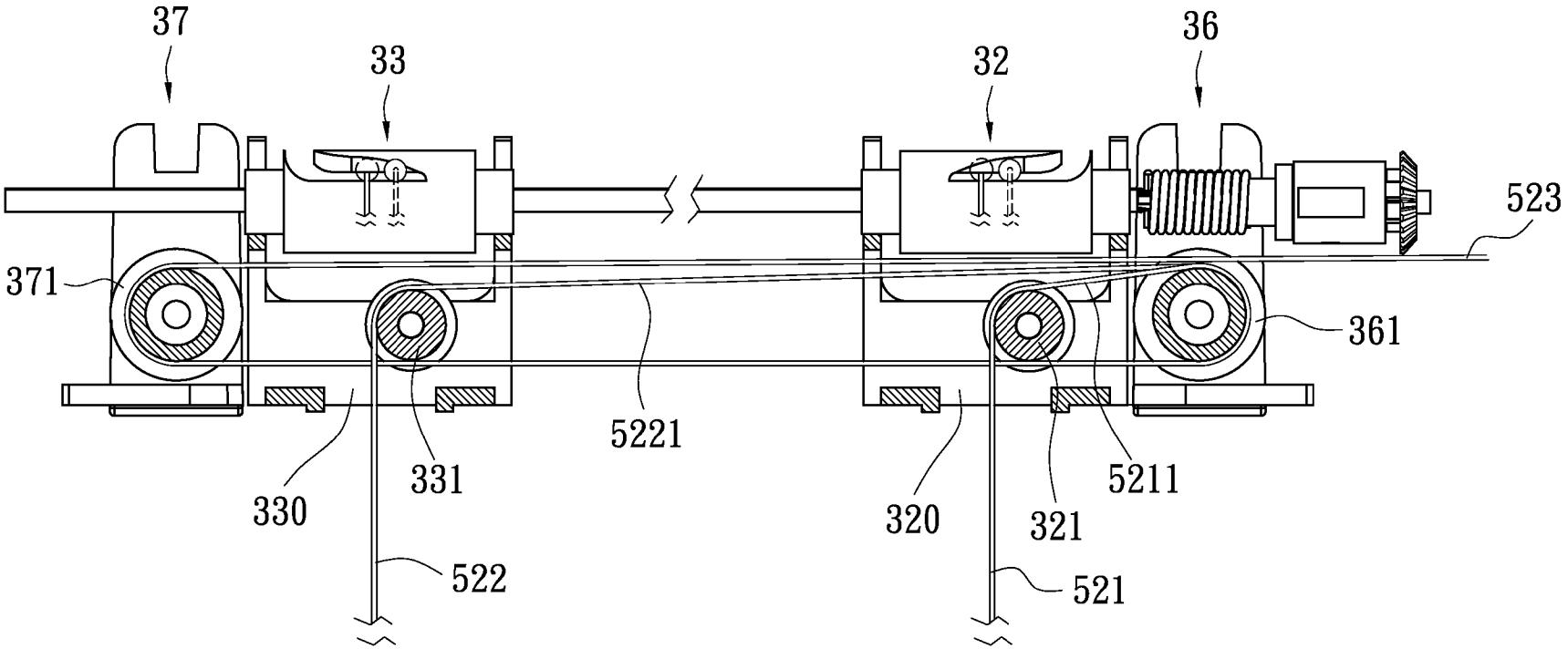
FIG. 4 is a fragmentary side view of the invention, showing the first and second cord directing sets and first and second cord directing wheels, partly cutaway.

The holding trough 31 of the upper rail 30 has two sides holding respectively a first cord wheel set 32 and a second cord wheel set 33 to direct a first lift cord 521 and a second lift cord 522 of the slat assembly 50. The first cord wheel set 32 and the second cord wheel set 33 have respectively a first holding seat 320 and a second holding seat 330 to hold respectively a first cord directing wheel 321 and a second cord directing wheel 331. The first and second holding seats 320 and 330 have respectively two corresponding latch side walls 322 and 332 extended upwards from the bottom thereof with a notch 323 and 333 formed thereon. The upper rail 30 further has a plurality of openings formed at the bottom. In this embodiment two openings, namely a first opening 34 and a second opening 35 are formed to hold respectively the first holding seat 320 and the second holding seat 330 that have respectively a first threading hole 324 and a second threading hole 334. At an outer side of the first and second holding seats 320 and 330, there is a first cord directing set 36 and a second cord directing seat 37 respectively for holding a cord directing shank 361 and 371 (referring to FIG. 4). The first and second lift cords 521 and 522 are threaded through the first and second threading hole 324 and 334 and extended and directed by the first and second cord directing wheels 321 and 331.

The lower rail 40 also is an elongate element located beneath the upper rail 30 and has a fastening element 41 on an upper end and two end caps 42 and 43 at two sides.

The slat assembly 50 is located between the upper rail 30 and the lower rail 40, and has slats 51 and a lift cord assembly 52 comprising the first and second lift cords 521 and 522. In the embodiment shown in the drawings, the first lift cord 521 has one end 5211 winding the first cord directing wheel 321 and threading between the first and second cord directing sets 36 and 37 to be fastened to a drawing rope 523 which in turns winds on a second transmission wheel 64 of the automatic retraction means 60, and another end 5212 threading through the first opening 34 of the upper rail 30 and the slats 51 and coupled to the lower rail 40. The second lift cord 522 also has one end 5221 winding the second cord directing wheel 331 and threading between the first and second cord directing sets 36 and 37 to be fastened to the drawing rope 523 which in turns winds the second transmission wheel 64 of the automatic retraction means 60, and the other end 5222 threading through the second opening 35 of the upper rail 30 and the slats 51 and coupled to the lower rail 40.

Figure 6:
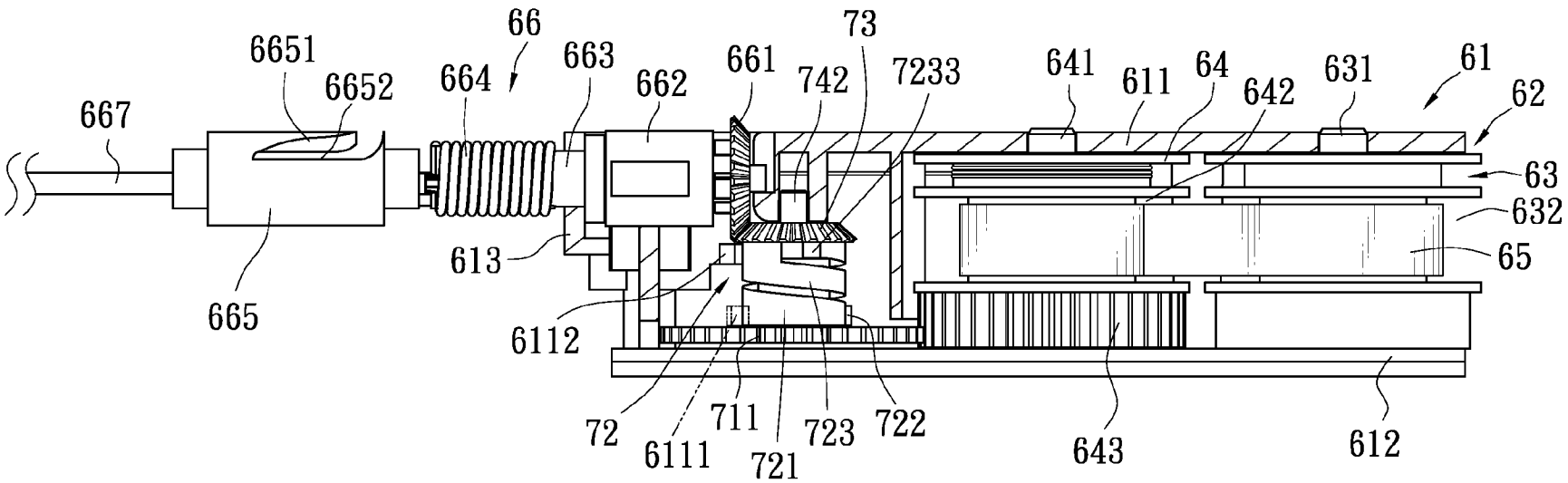
FIG. 6 is a side view of the automatic retraction means and slat opened/closed control means of the invention in a coupled condition.

Referring to FIGS. 2 and 6, the automatic retraction means 60 is held in the upper rail 30 and linked to the slat assembly 50. It has a retaining set 61 pivotally coupled by a transmission set 62 inside. The transmission set 62 has a first transmission wheel 63, a second transmission wheel 64 and an elastic element 65, and a second bevel gear 661 located on the reel set 66 engaging with a first bevel gear 73 located on the slat opened/closed control means 70.

The retaining set 61 includes at least an upper press plate 611, a lower press plate 612 and a retaining member 613. There are a first transmission wheel 63 and a second transmission wheel 64 pivoted between the upper and lower press plates 611 and 612. The upper and lower press plates 611 and 612 are fastened together through struts 614 and fastening elements 615 such as screws. The upper press plate 611 further has a right blocking member 6112 on an inner side of one end formed at an elevation higher than a left blocking member 6111 (referring to FIG. 9), and two corresponding clipping members 6113 at the same side with a groove 6114 formed thereon.

The retaining member 613 is located at other side of the upper press plate 611 and has a fastening dock 6131 with a recess chamber 6132 formed inside to facilitate fastening to the upper side of the slat opened/closed control means 70.

Figure 7:
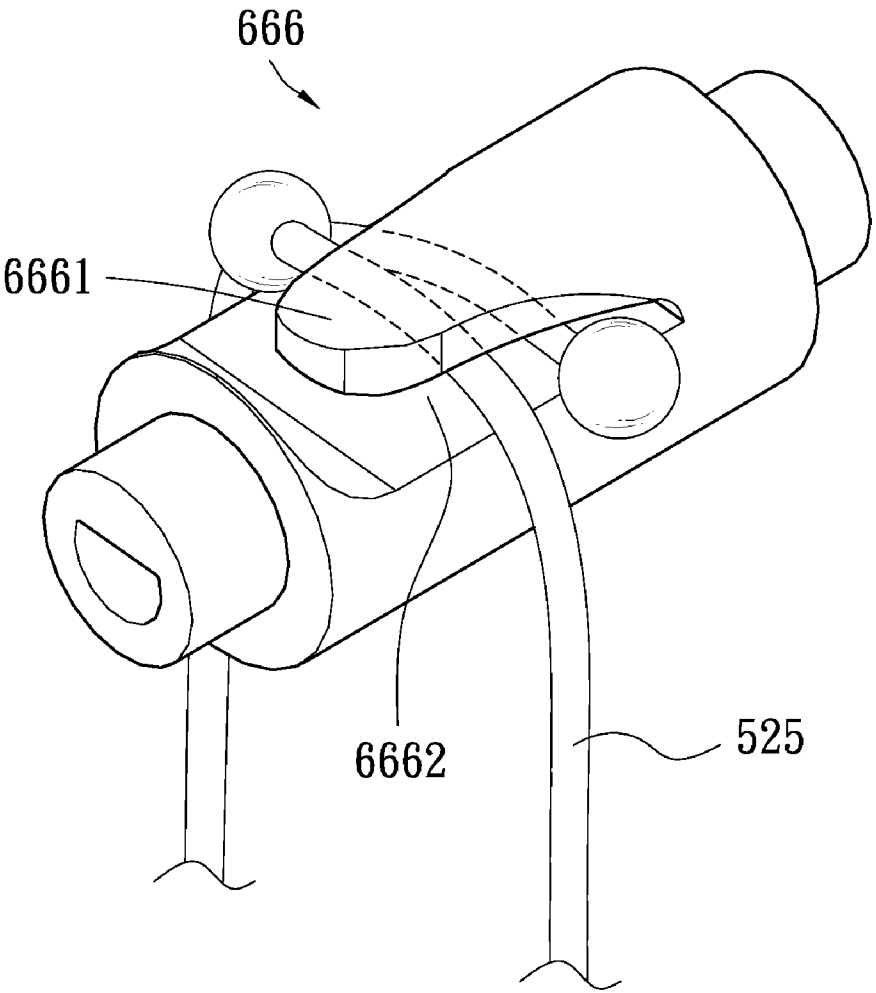
FIG. 7 is a perspective view of the reel of the invention in a cord winding condition.

The transmission set 62 is pivotally located between the upper and lower press plates 611 and 612. The first and second transmission wheels 63 and 64 have respectively a protruded portion 631 and 641 on an upper side with a recess formed thereon, and an annular indented groove 632 and 642 formed in a middle portion. The second transmission wheel 64 further has a second gear 643 formed on the perimeter of a distal end thereof. The elastic element 65 can be an S-shaped elastic reed with two ends respectively coupling to the annular indented groove 632 and 642 of the first and second transmission wheels 63 and 64. The reel set 66 includes at least one second bevel gear 661 engaging with the first bevel gear 73 of the slat opened/closed control means 70 for transmission, a bushing 662 fastened to the recess chamber 6132 of the fastening dock 6131, and a stem 663 which has one end running through the bushing 662 and fastened to the second bevel gear 661 held in the groove 6114 of the two clipping members 6113 and other end coupling with an flexible coupler 664, and a transmission rod 667 is coupled with a first reel 665 and a second reel 666 closed to two ends thereof, and having one end fastened to the flexible coupler 664. Referring to FIGS. 2 and 7, the first and second reels 665 and 666 are latched in the notches of the latch side walls 322 and 332 at two sides of the first and second holding seats 32 and 33 with respectively a jutting latch member 6651 and 6661 formed on an outer side and a threading slot 6652 and 6662 formed thereon to be threaded through in a staggered fashion by coupling cords 524 and 525 linking two sides of the slats 51. The coupling cords 524 and 525 have distal ends fastened to two sides of the jutting latch members 6651 and 6661.

Figure 15:
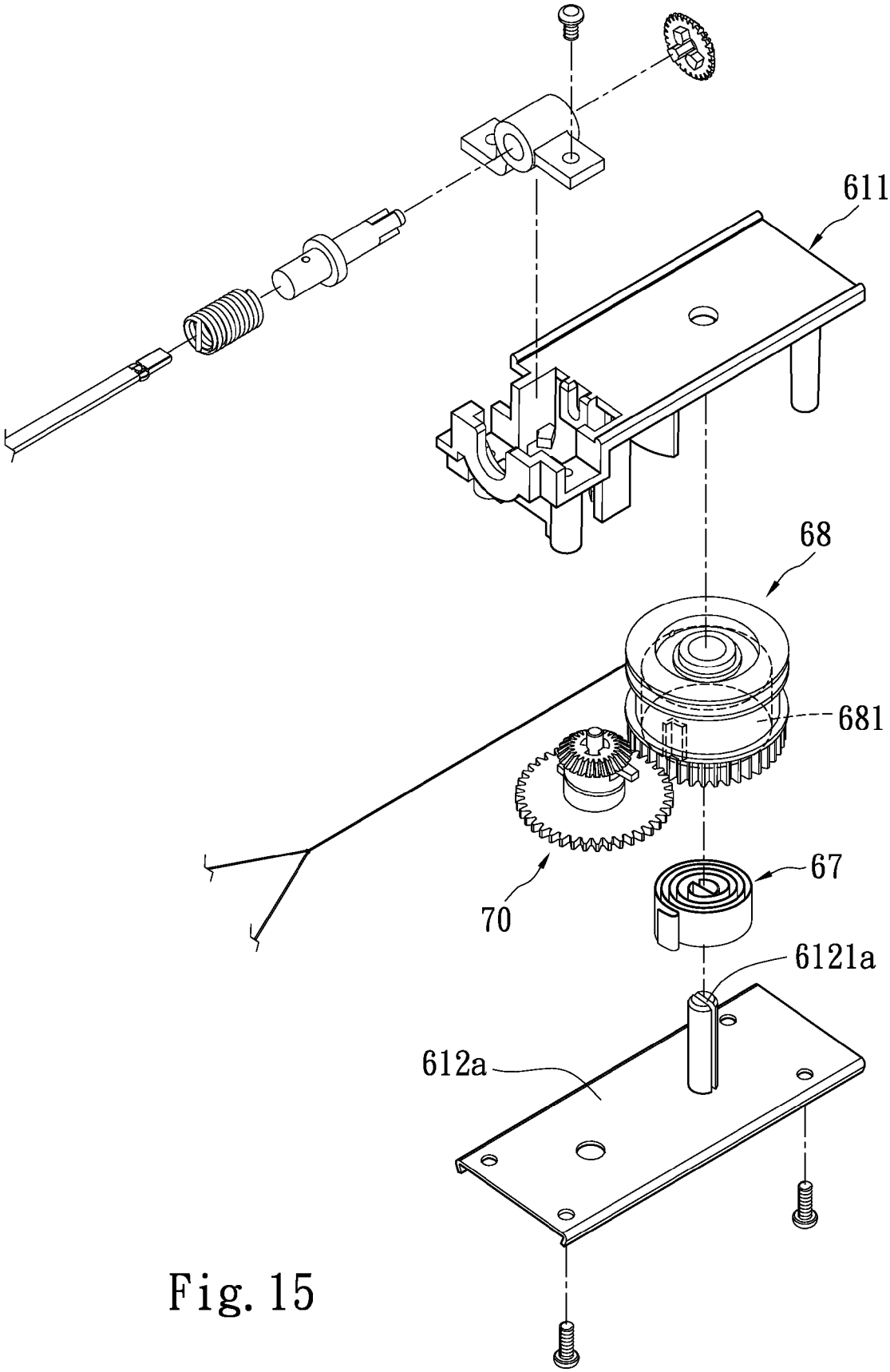
FIG. 15 is an exploded view of another embodiment of the transmission set of the invention.

Referring to FIG. 15, in other application of the present invention, the transmission set 62 can has a transmission wheel 68 which has a holding chamber 681 and a volute spring 67 located in the holding chamber 681, and is held by a holding stem 6121 a bridging the upper press plate 611 and the lower press plate 612*a*. The transmission wheel 68 and the slat opened/closed control means 70 are transmitted the same as that of the transmission set 62, thus details are omitted herein.

Figure 5:
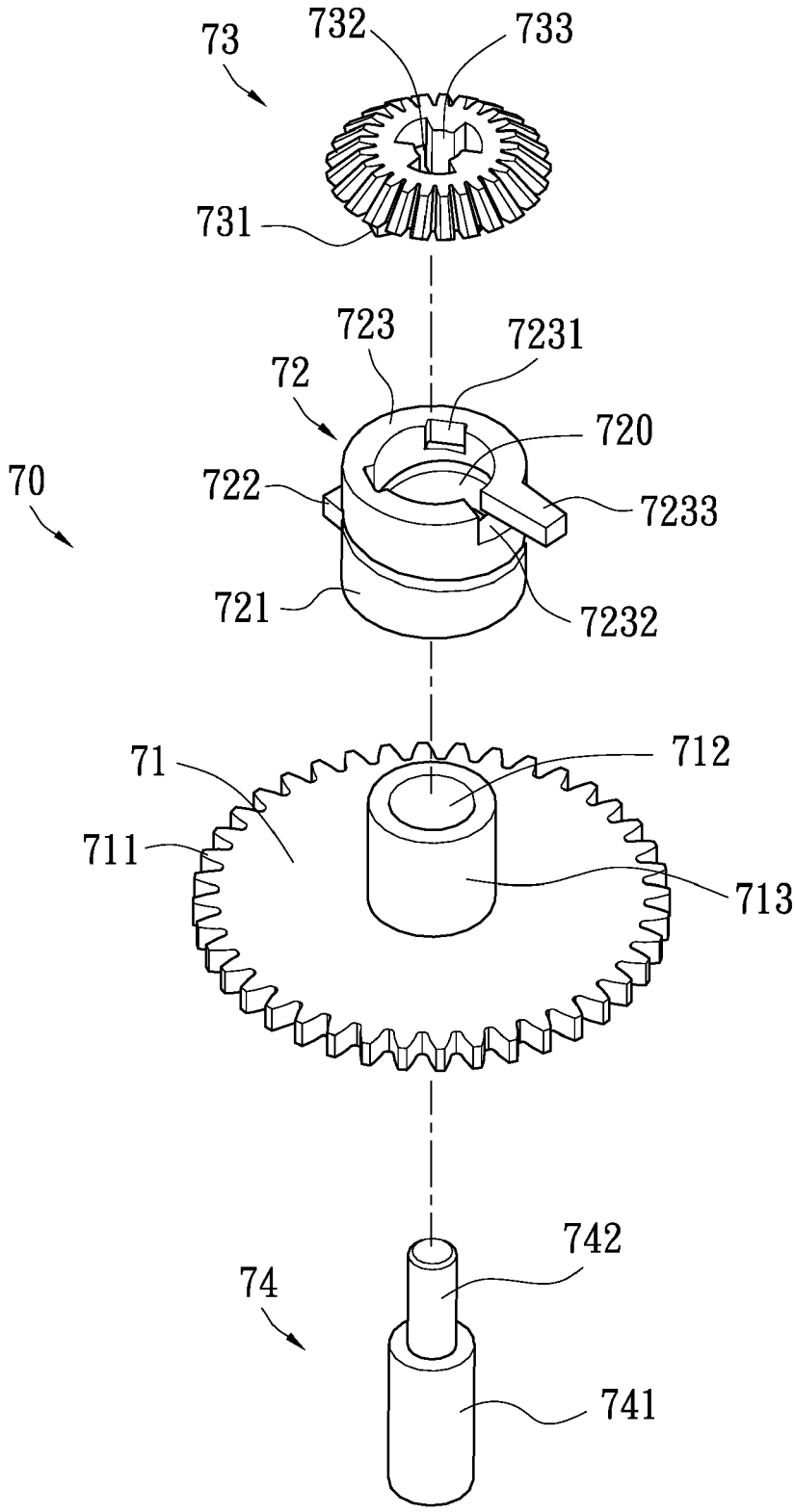
FIG. 5 is an exploded view of the slat opened/closed control means of the invention.

Also referring to FIG. 5, the slat opened/closed control means 70 is located in the upper rail 30 and engaged with the reel set 66 and transmission set 62 of the automatic retraction means 60. It includes an adjustment member 72, the first bevel gear 73 fastened to the adjustment member 72, and a transmission wheel 71 which is located at the bottom of the slat opened/closed control means 70 having a shaft portion 74.

The transmission wheel 71 has a third gear 711 formed on the perimeter and a stem 713 on an upper side with an aperture 712 formed thereon to hold the shaft portion 74 of the same diameter.

The adjustment member 72 is a helical elastic element and has a coupling hole 720 formed therein to hold the stem 713 of the transmission wheel 71 in a compact manner so that the transmission wheel 71 and the adjustment member 72 are turnable synchronously. It also has a lower elastic element 721 with a lower blocking member 722 formed on an outer edge and an upper side coupling with the upper elastic element 723. The upper elastic element 723 has at least one wedge notch 7231 on an inner side and a notch 7232 and an upper blocking member 7233 extended from an outer edge thereof. Such that when the adjustment member 72 turns counterclockwise, the lower blocking member 722 is stopped by the left blocking member 6111, and the helical elastic element is resisted by the counter helical force to relax a clipping force stored therein so that the transmission wheel 71 does not drive the adjustment member 72 and rotates idly (also referring to FIG. 13). When the adjustment member 72 turns clockwise, the upper blocking member 7233 stopped by the right blocking member 6112, and the helical elastic element is resisted by the counter helical force to relax the clipping force so that the transmission wheel 71 does not drive the adjustment member 72 and rotates idly (also referring to FIG. 9).

The first bevel gear 73 is fastened to the upper side of the adjustment member 72 and has a wedge 731 at the bottom to wedge in one or more wedge notch 7231 formed on the adjustment member 72. It also has a center hole 732 with one or more latch member 733 formed thereon to be pivotally coupled with a second shaft end 742 of the shaft portion 74 to form a latched condition.

The shaft portion 74 has a first shaft end 741 at a lower side and the second shaft end 742 at an upper side to pivotally couple with the transmission wheel 71 and the first bevel gear 73 for turning.

Figure 16:
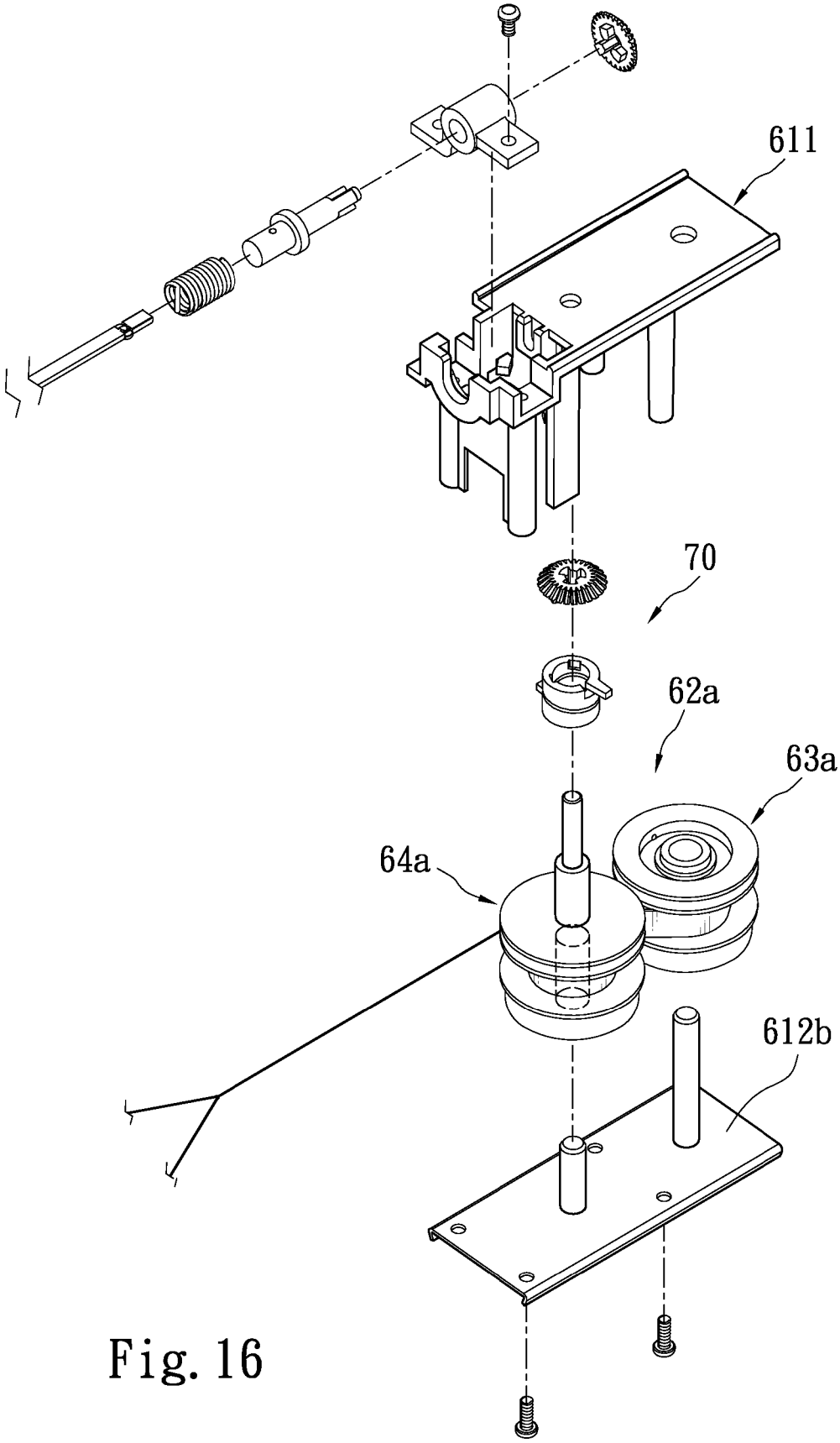
FIG. 16 is an exploded view of the invention, showing the slat opened/closed control means coaxially installed on the transmission set.

Referring to FIG. 16, the slat opened/closed control means 70 may also be coaxially coupled with a transmission set 62*a* held in the space of the upper rail that has a first and second transmission wheel 63*a* and 64*a*. The transmission set 62*a* is pivotally coupled between the upper and lower press plates 611 and 612*b*.

Figure 17:
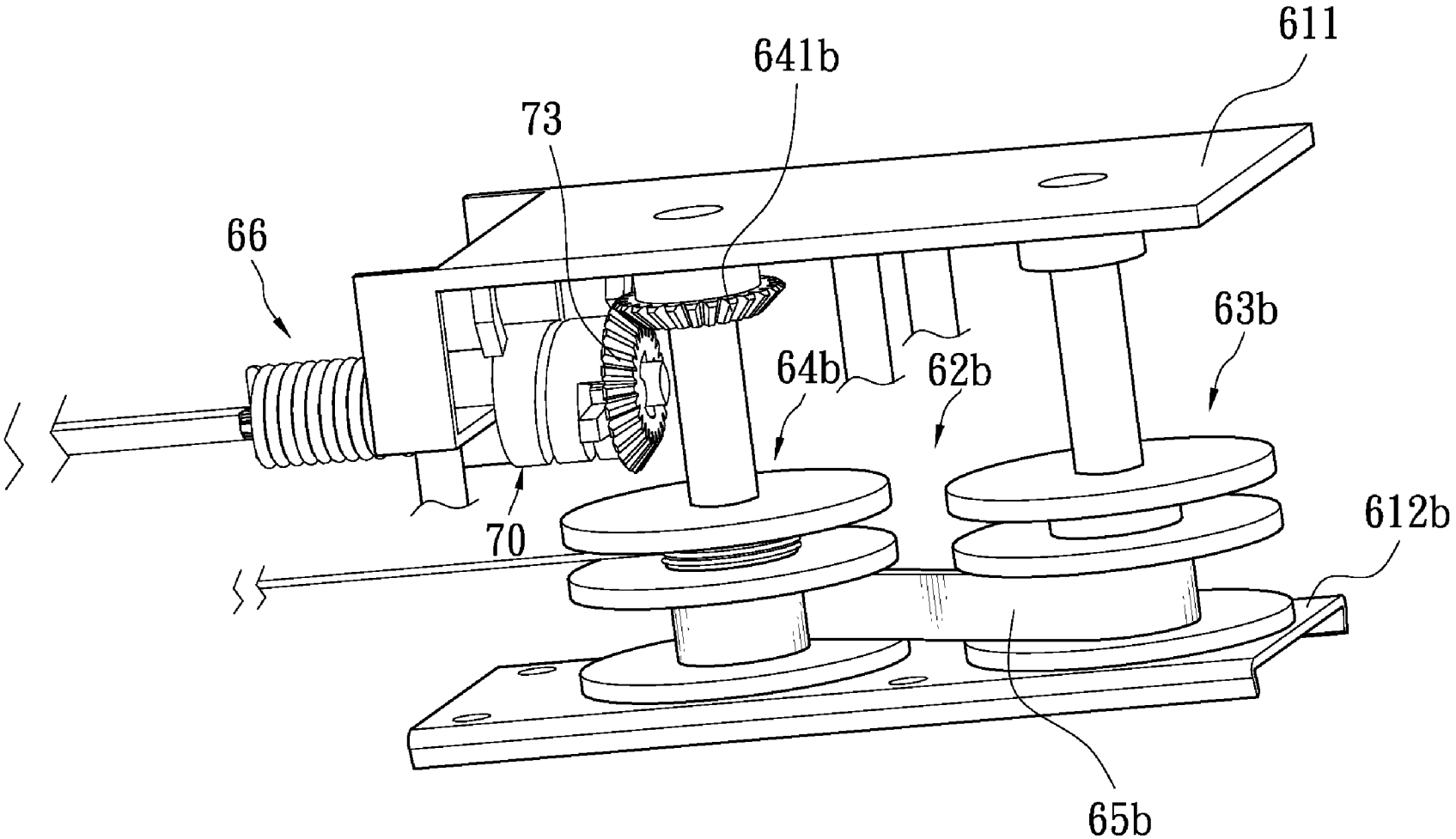
FIG. 17 is a combination view of the invention, showing the slat opened/closed control means coaxially installed on the reel set.

Referring to FIG. 17, the slat opened/closed control means 70 may also be coaxially coupled with the reel set 66 held in the space of the upper rail. Through engaging and transmission of the first bevel gear 73 and another bevel gear 641*b* mounted on the transmission set 62*b*. Moreover, the transmission set 62*b* has a first transmission wheel 63*b* and a second transmission wheel 64*b* pivotally coupled between the upper and lower press plates 611 and 612*b* linked by two ends of the elastic element 65*b*. Such a structure can facilitate retraction and extension of the slat assembly 50.

Figure 18:
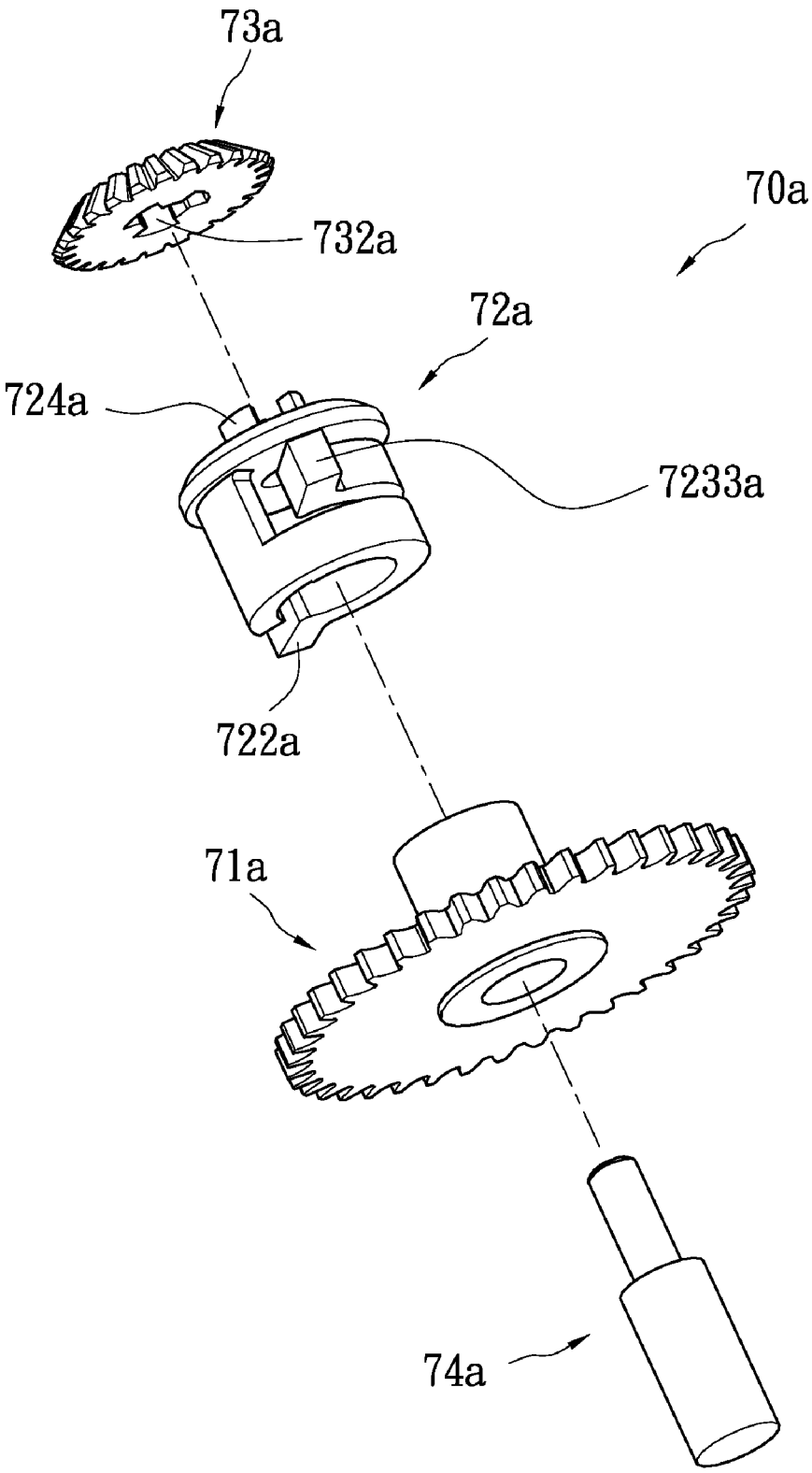
FIG. 18 is an exploded view of another embodiment of the adjustment member.

Referring to FIG. 18, the adjustment member 72*a* may be formed in a parallel encasing body including an upper blocking member 7233*a* and a lower blocking member 722*a*, and a wedge 724*a* located at the top to wedge in a wedge hole 732*a* of the first bevel gear 73*a* so that it can be pivotally coupled with the transmission wheel 71*a* and the shaft portion 74*a* to transmit rotation.

Figure 19:
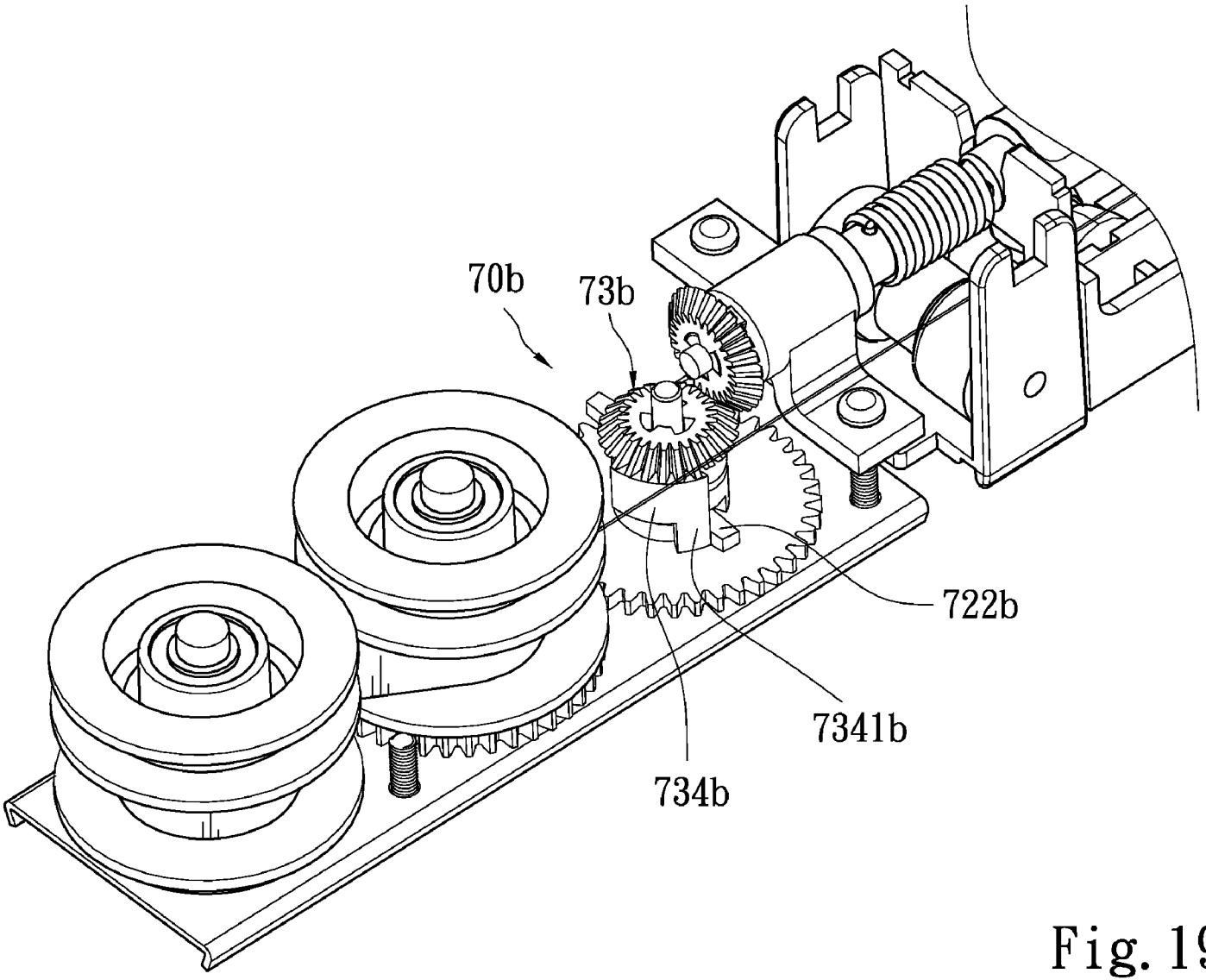
FIG. 19 is a perspective view of another embodiment of the first bevel gear of the slat opened/closed control means.
Figure 20:
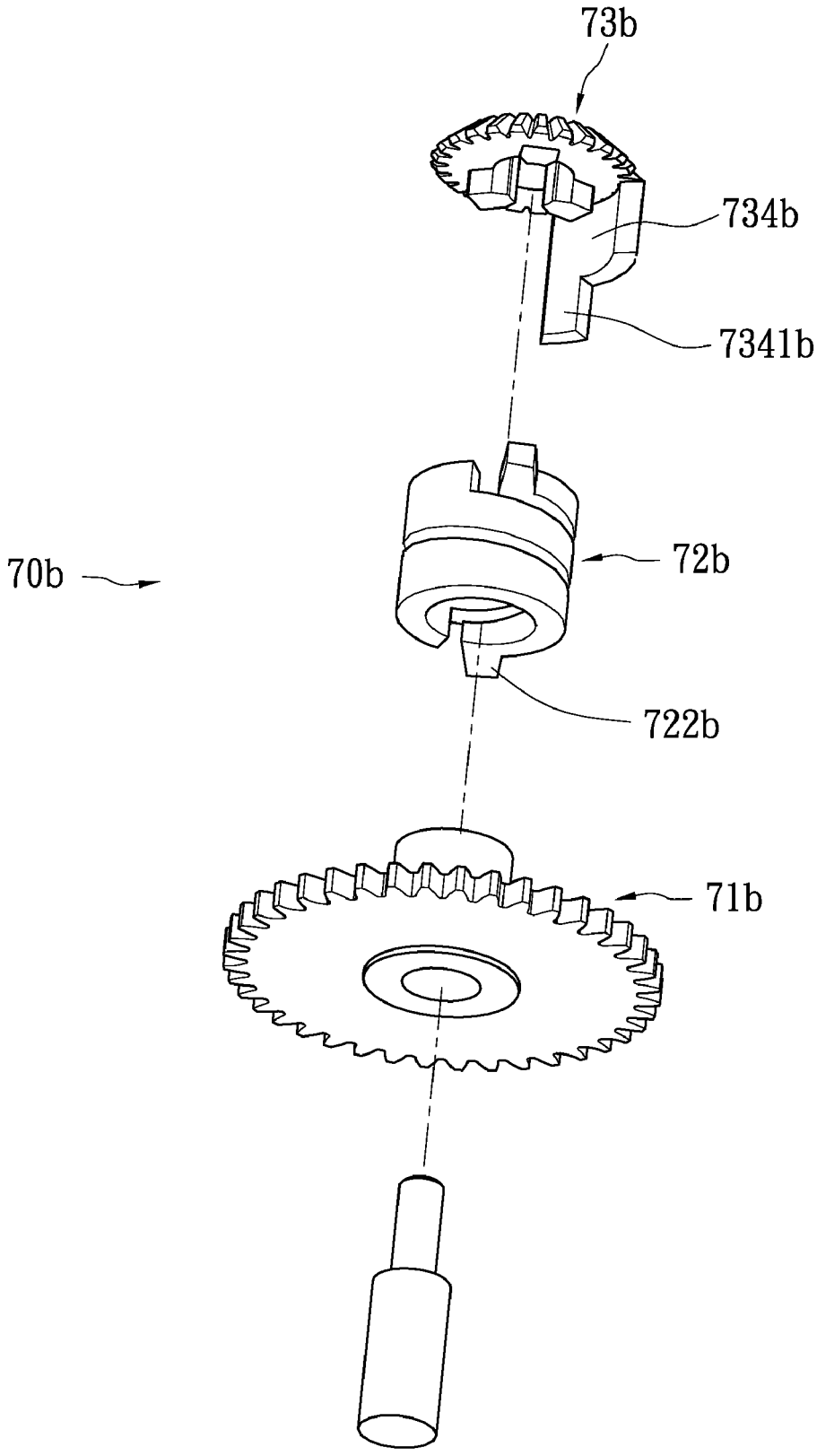
FIG. 20 is an exploded view of the slat opened/closed control means according to FIG. 19.
Figure 21:
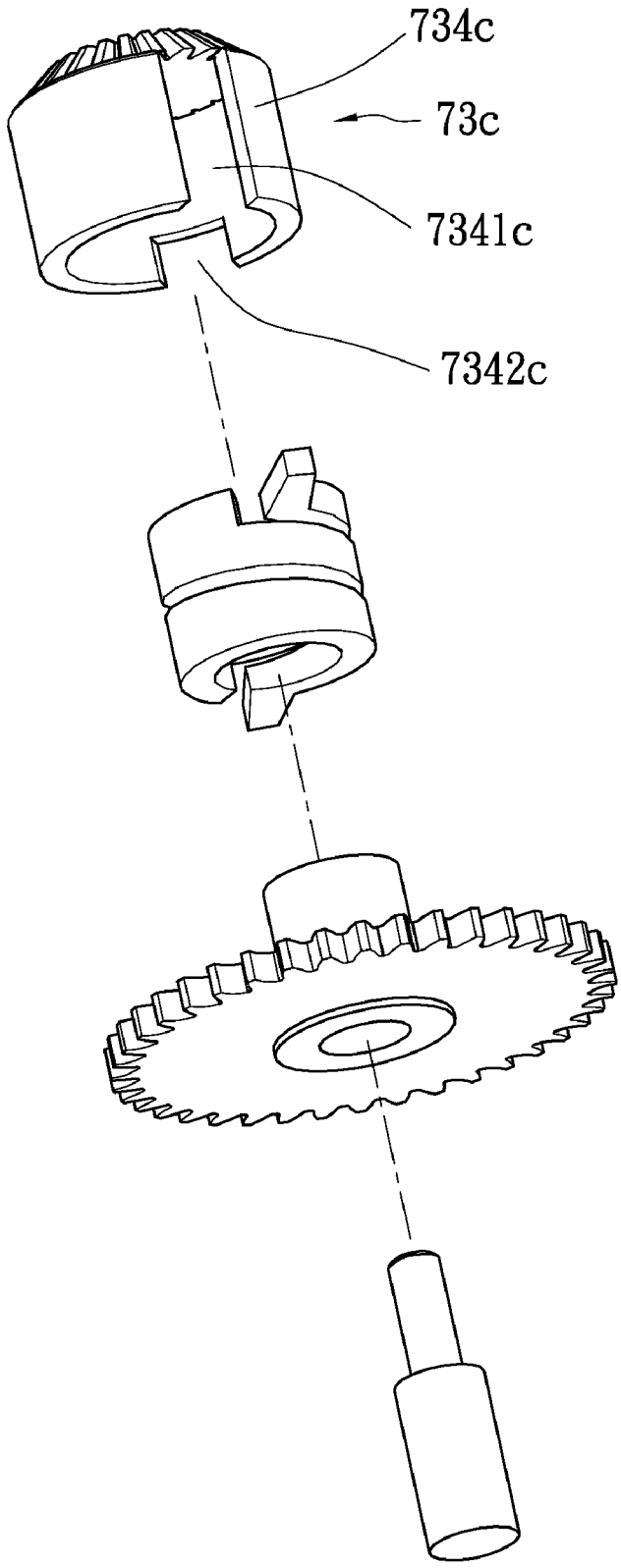
FIG. 21 an exploded view of yet another embodiment of the first bevel gear of the slat opened/closed control means.

Referring to FIGS. 19 and 20, in other application of the present invention, the first bevel gear 73*b* of the slat opened/closed means 70*b* has an extended member 734*b* at one edge with a lower edge blocking member 7341*b* formed thereon. When the lower rail is moved upwards, the transmission wheel 71*b*, adjustment member 72*b* and first bevel gear 73*b* turn counterclockwise, the lower edge blocking member 7341*b* presses against the lower blocking member 722*b* first so that the inner side of the adjustment member 72*b* generates a greater clipping force to drive the transmission wheel 71*b* to rotate with the adjustment member 72*b* at the same time until stopped by the left blocking member (not shown in the drawings); then it is released. In other application as shown in FIG. 21, the first bevel gear 73*c* may have a barrel 734*c* formed on the periphery. The barrel 734*c* has a slot 7341*c* and a gap 7342*c* at the bottom.

Figure 14:
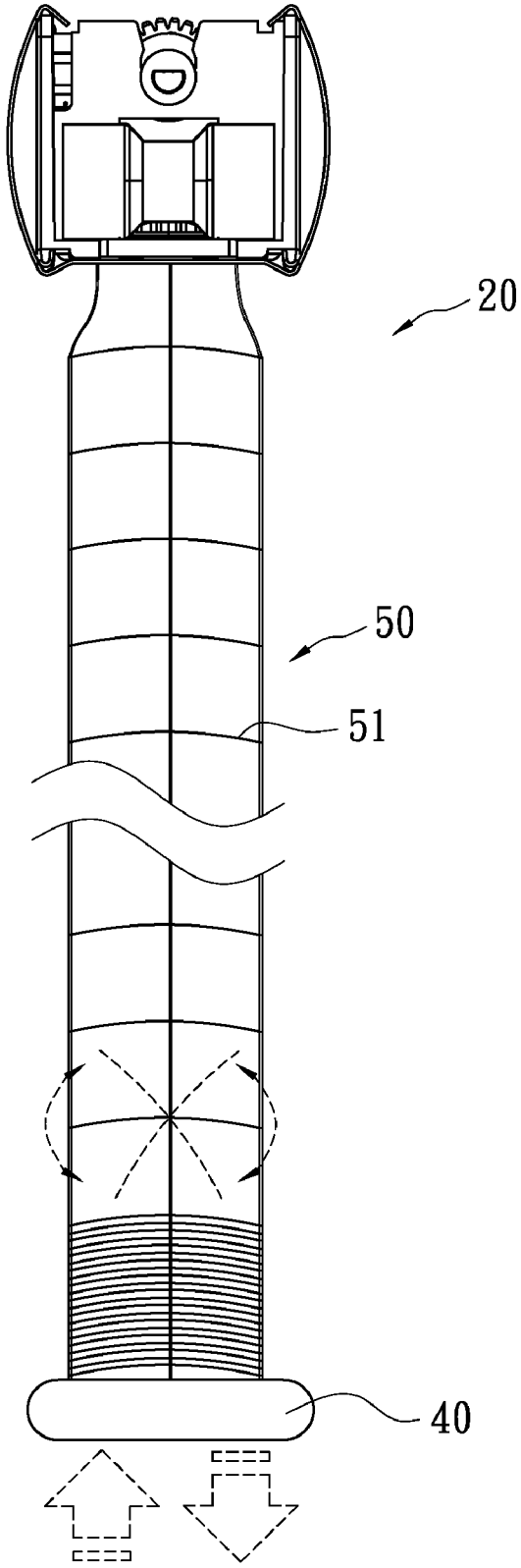
FIG. 14 is a schematic view of the invention to control opened/closed angle of the slat assembly by pulling downwards and pushing upwards.

For assembly and installation of the Venetian blind 20 of the invention, referring to FIG. 3, first, install the automatic retraction means 60 and the slat opened/closed control means 70 in the holding trough 31 of the upper rail 30; wind one end 5211 of the first lift cord 521 on the first cord directing wheel 321 (referring to FIG. 4), and thread it between the first and second cord directing sets 36 and 37, then fasten to the drawing rope 523 and wind on the second transmission wheel 64 of the automatic retraction means 60. Thread the other end 5212 through the first opening 34 of the upper rail 30 and the slats 51 (referring to FIG. 2) and fasten to the fastening element 41 and the lower rail 40. Next, wind one end 5221 of the second lift cord 522 on the second cord directing wheel 331 and thread between the first and second cord directing sets 36 and 37, and fasten to the drawing rope 523 and wind on the second transmission wheel 64 of the automatic retraction means 60. Thread the other end 5222 through the second opening 35 of the upper rail 30 and the slats 51 (referring to FIG. 2) and fasten to the fastening element 41 and the lower rail 40. When in use, the lower rail 40 is pulled downwards or pushed upwards. The automatic retraction means 60 can hold the lower rail 40 at any position as desired so that the slats are in a suspended or retracted condition. By turning the second gear 643 of the second transmission wheel 64, the adjustment member 72 of the slat opened/closed control means 70 can be turned forwards or reverse and latched on the right blocking member 6112 or left blocking member 6111. Namely, the lower rail 40 can be pulled downwards or pushed upwards at a shortest distance to position the slats 51 of the slat assembly 50 at a desired open or closed angle (referring to FIG. 14).

Figure 8:
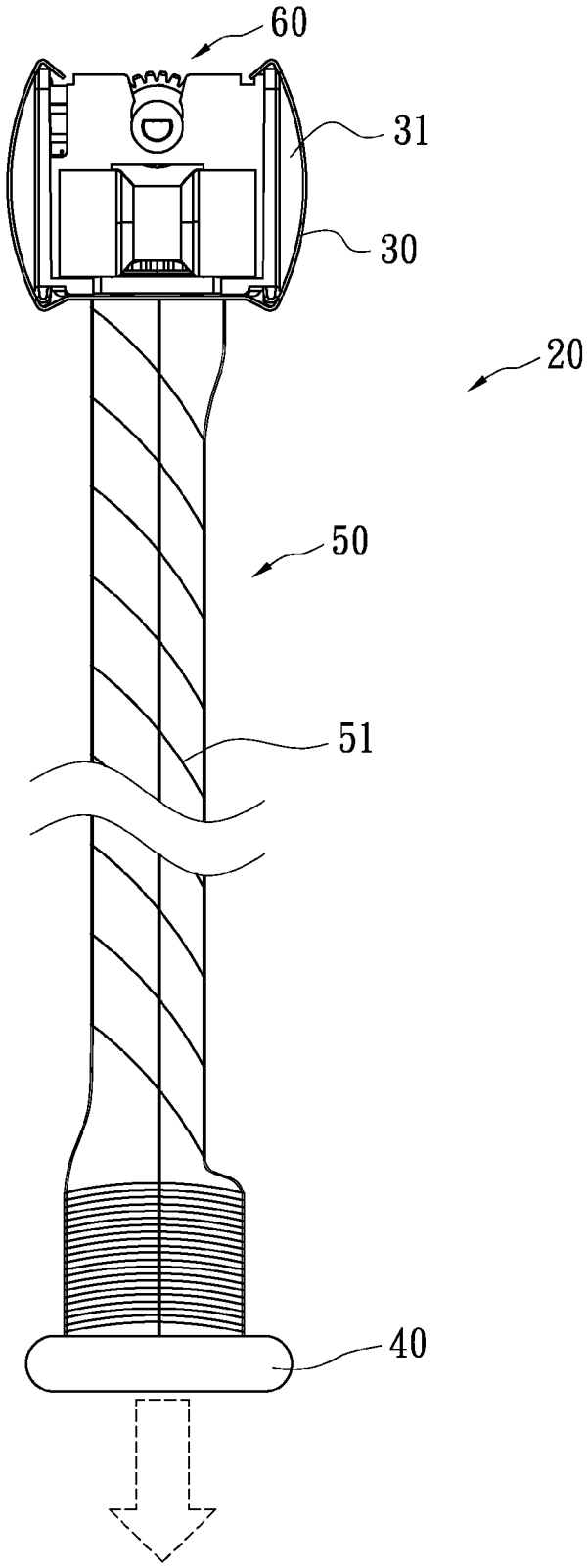
FIG. 8 is a schematic view of the slat assembly of the invention, pulled downwards at a selected angle.
Figure 9:
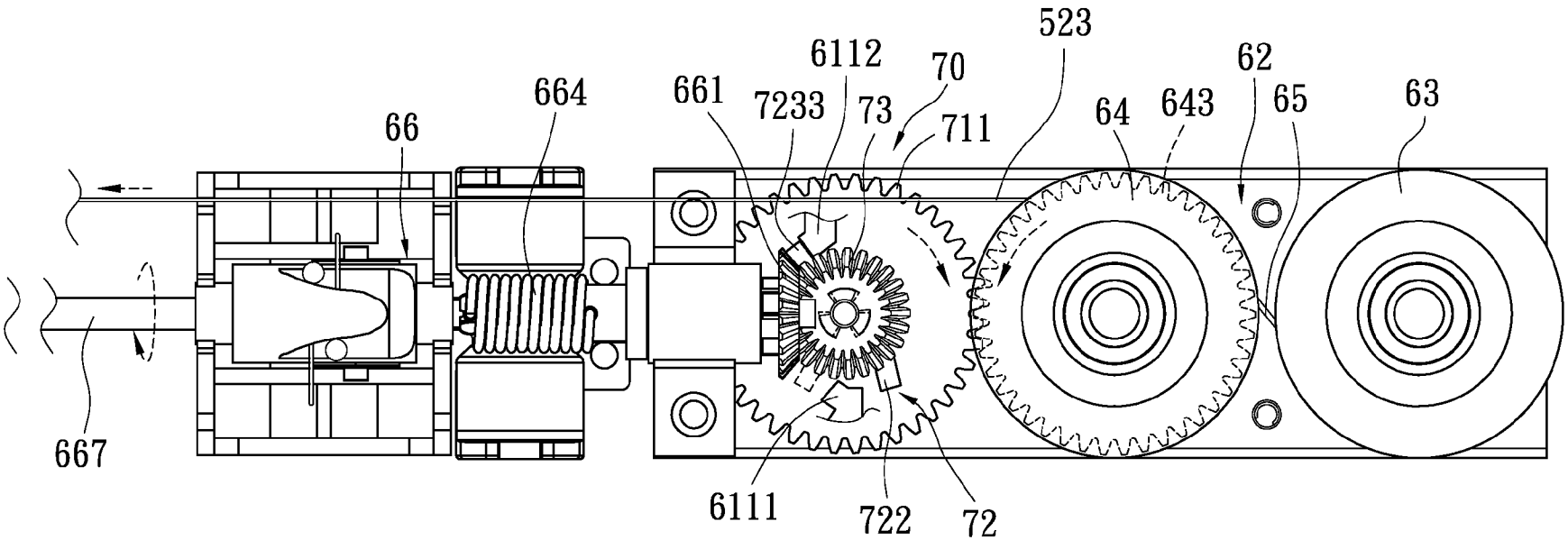
FIG. 9 is a schematic view of transmission between the automatic retraction means and slat opened/closed control means according to FIG. 8.

Also referring to FIGS. 6, 8 and 9, to open or close the slats 51 of the slat assembly 50 at a desired angle, first, pull the lower rail 40 downwards and turn the automatic retraction means 60 held in the holding trough 31 of the upper rail 30; the S-shaped elastic element 65 linking the first and second transmission wheels 63 and 64 of the transmission set 62 is extended, and the second gear 643 drives the third gear 711 of the slat opened/closed control means 70 to turn clockwise and also drives the adjustment member 72 to rotate forwards; the upper blocking member 7233 also turns clockwise until stopped by the right blocking member 6112 to become rotating idly (referring to FIG. 9). Hence when the adjustment member 72 is not yet stopped by the right blocking member 6112 and compressed, pulling the lower rail 40 allows the third gear 711 to drive the first bevel gear 73 turning, which in turn drives the second bevel gear 661 at the same time in the reverse direction so that the reel set 66 also rotates in the reverse direction to drive the flexible coupler 664 and transmit rotation to the transmission rod 667. As a result, the slats 51 of the slat assembly 50 can be turned to open or close as desired (referring to FIG. 8).

Figure 10:
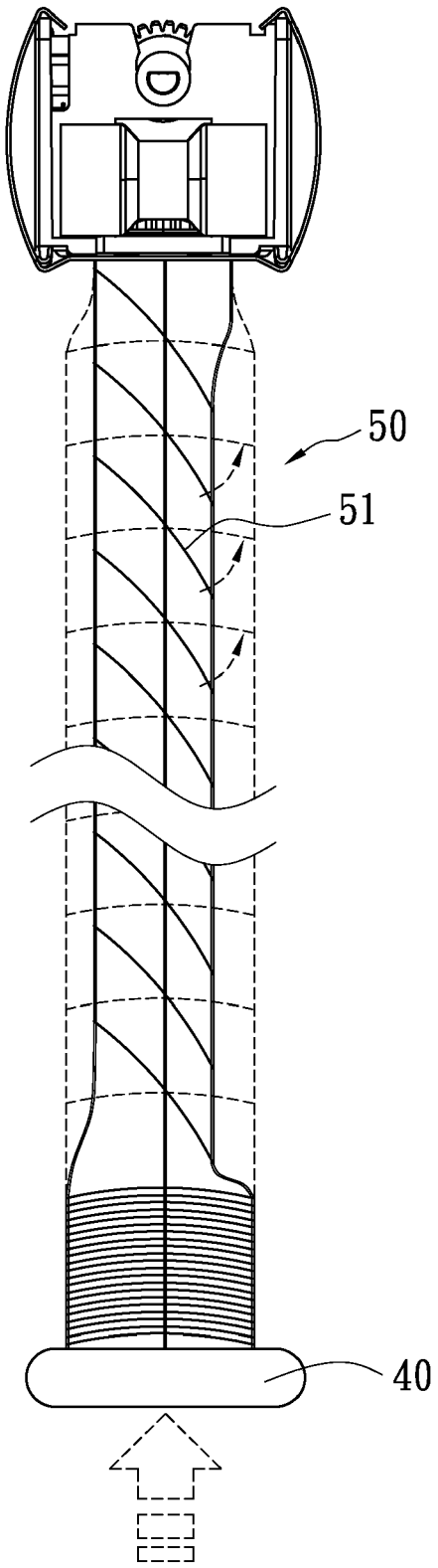
FIG. 10 is a schematic view of the slat assembly of the invention, moved upwards in a parallel and aligned condition.
Figure 11:
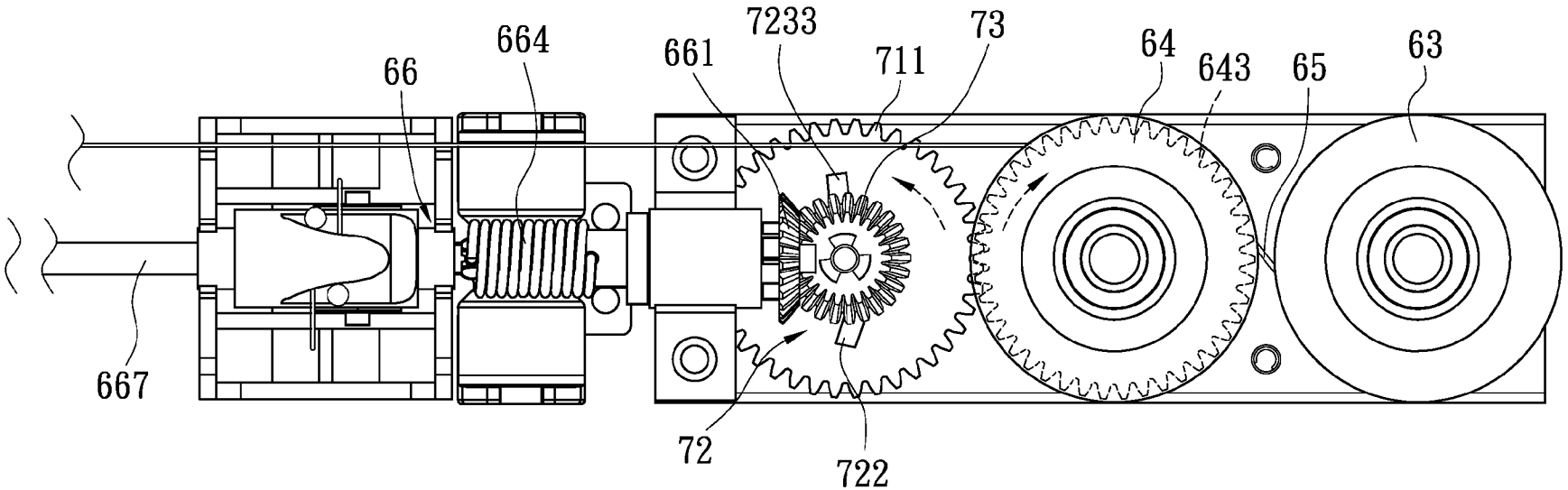
FIG. 11 is a schematic view according to FIG. 10, showing the angle of the helical elastic element when the slat assembly is in a parallel condition.

Also referring to FIGS. 6, 10 and 11, when the lower rail 40 is moved upwards, the S-shaped elastic element 65 between the first and second transmission wheels 63 and 64 is retracted, the second gear 643 turns clockwise to drive the third gear 711; the adjustment member 72 does not press the left blocking member 6111 and is in a contracted and clipping condition, thus can be driven by the third gear 711 to rotate in the reverse direction (as shown in FIG. 11); the first bevel gear 73 also turns in the reverse direction at the same time and drives the second bevel gear 661 to rotate in the forward direction; namely, the reel set 66 also rotates in the forward direction and drives the flexible coupler 664 to transmit rotation to the transmission rod 667 so that the slats 51 of the slat assembly 50 can be turned horizontally from the closed angle (referring to FIG. 10). When the adjustment member 72 is turned to a selected angle (referring to FIG. 11) and the upward movement of the lower rail 40 is stopped, the slats 51 of the slat assembly 50 are maintained in the horizontal condition.

Figure 12:
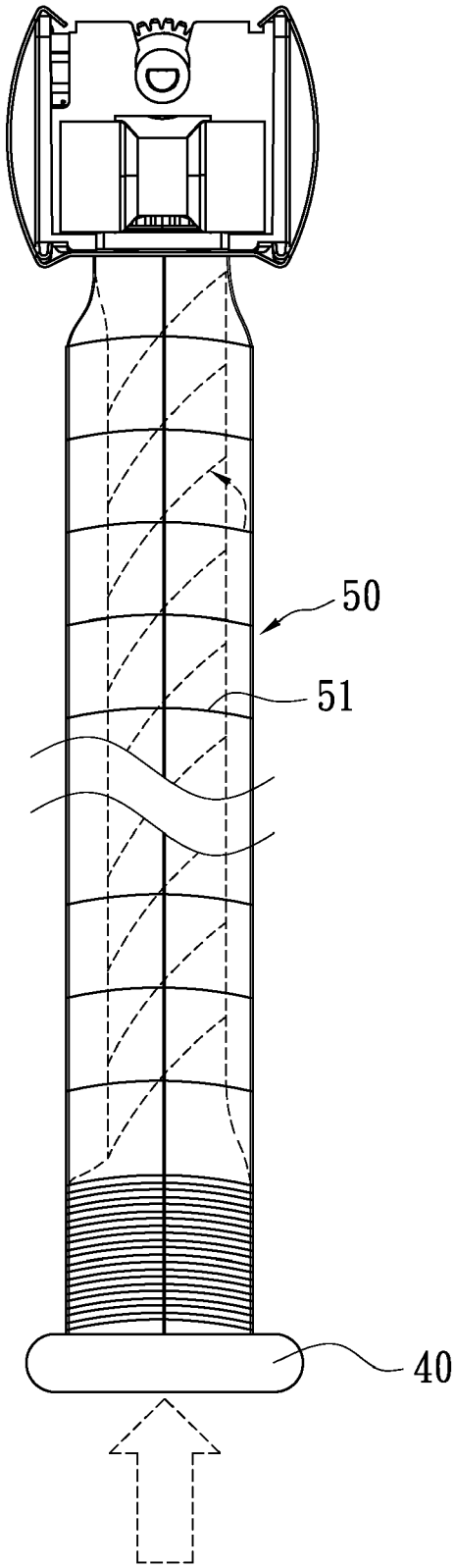
FIG. 12 is a schematic view of the slat assembly of the invention, moved upwards at another angle.
Figure 13:
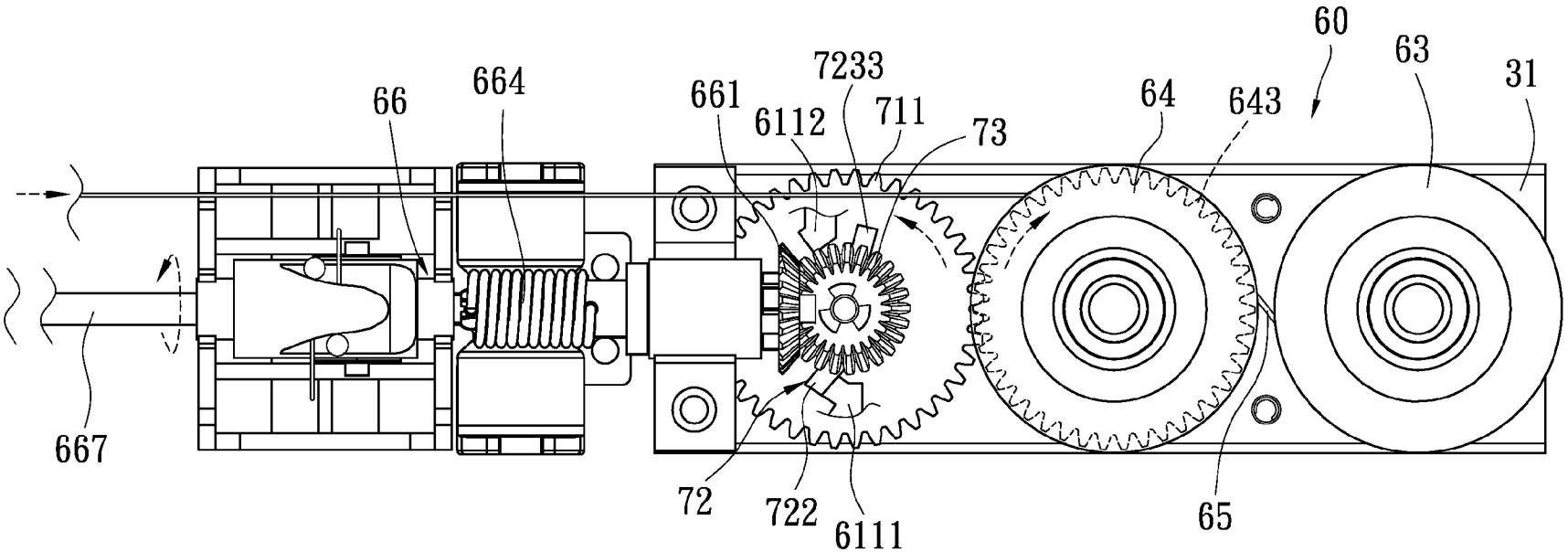
FIG. 13 is a schematic view of transmission between the automatic retraction means and slat opened/closed control means according to FIG. 12.

Referring to FIGS. 6, 12 and 13, when the lower rail 40 is moved continuously upwards, through contraction of the S-shaped elastic element 65 between the first and second transmission wheels 63 and 64, the second gear 643 rotates continuously clockwise to drive the third gear 711 and the adjustment member 72 to rotate counterclockwise (referring to FIG. 13); the transmission rod 667 also rotates continuously so that the slat assembly 50 turns from the horizontal direction to the original direction until the reverse-rotating lower blocking member 722 is stopped by the left blocking member 6111 to form idle rotation; then the slat assembly 50 is turned to another closed condition (referring to FIG. 12).

As a conclusion, the invention, by merely pushing the lower rail 40 upwards or moving the lower rail 40 downwards can adjust extension, retraction and turning angle of the slats 51. Operation is simple, easy and consistent, and the benefit of the cordless blind can be realized.

What is claimed is:

1. A Venetian blind, comprising:

an elongate upper rail;

a lower rail spaced from the upper rail at a lower side;

a slat assembly which is located between the upper rail and the lower rail and has slats and a lift cord assembly passing through the slats, and two coupling cords;

an automatic retraction means which is located in the upper rail and coupled with the slat assembly and has a retaining set, a transmission set pivotally coupled inside and a reel set mounted on the retaining set, the transmission set and the reel set are wound by the lift cord assembly; and a slat opening/closing control device which is located in the upper rail and includes a transmission wheel engaging with the transmission set, a helical elastic adjustment member installed on the transmission wheel, and a first bevel gear correspondingly fastened to the adjustment member and engaging with the reel set;

wherein the slats are inclined to a desired angle by the coupling cords through rotating of the reel set that is driven by the first bevel gear rotating with the adjustment member and the transmission wheel transmitted by the transmission set through pulling of the lift cord assembly when the lower rail is moved relative to the upper rail.

2. The Venetian blind of claim 1, wherein the transmission set of the automatic retraction means has an elastic element.

3. The Venetian blind of claim 2, wherein the elastic element is an S-shaped elastic reed.

4. The Venetian blind of claim 3, wherein the transmission set includes a first transmission wheel and a second transmission wheel which has a gear formed on the perimeter of a distal end of the second transmission wheel, which is pivotally coupled to the retaining set, the elastic element having two ends linked, respectively, to the first transmission wheel and the second transmission wheel.

5. The Venetian blind of claim 4, wherein the first transmission wheel has a protruded portion on an upper side thereof and an annular indented groove on a middle portion, the second transmission wheel having another annular indented groove on another middle portion thereof corresponding to the first transmission wheel.

6. The Venetian blind of claim 1, wherein the lift cord assembly has a first lift cord and a second lift cord linking to the automatic retraction means.

7. The Venetian blind of claim 1, wherein the retaining set includes at least an upper press plate, a lower press plate and a retaining member.

8. The Venetian blind of claim 7, wherein the upper press plate has a right blocking member and a left blocking member on an inner side of one end formed at an elevation higher than the left blocking member, and two corresponding clipping members at the same end that have a groove formed thereon.

9. The Venetian blind of claim 7, wherein the retaining member is located at one side of the upper press plate and has a fastening dock formed with a recess chamber.

10. The Venetian blind of claim 1, wherein the reel set includes at least a second bevel gear engaging with the first bevel gear of the slat opening/closing control device for transmission, a bushing fastened to the retaining member and a stem which has one end running through the bushing and fastened to the second bevel gear held at one side of the retaining set and the other end coupling with a flexible coupler, a transmission rod has two ends running through respectively a first reel and a second reel that have respectively a jutting latch member on an outer side and a threading slot formed thereon, the stem transmitting rotation to the transmission rod through the flexible coupler.

11. The Venetian blind of claim 1, wherein the upper rail has a plurality of openings at the bottom to hold a first cord directing set and a second cord directing set, the first and second cord directing sets having respectively a first holding seat and a second holding seat that hold respectively a first cord directing wheel and a second cord directing wheel and have two corresponding latch side walls extended from the bottom thereof that have a notch.

12. The Venetian blind of claim 1, wherein the adjustment member is a helical elastic element and has a coupling hole inside to hold a stem of the transmission wheel, including a lower elastic element and an upper elastic element, the lower elastic element having a lower blocking member on an outer edge and an upper side coupling with the upper elastic element, the upper elastic element having at least one wedge notch on an inner side and a notch and an upper blocking member extended from an outer edge thereof.

13. The Venetian blind of claim 1, wherein the adjustment member is a parallel encasing body and has an upper blocking member and a lower blocking member, and a wedge at the top to engage with the first bevel gear.

14. The Venetian blind of claim 1, wherein the first bevel gear has at least one wedge at the bottom and a center hole having at least one latch member on an inner side to couple and latch with a shaft portion of the slat opening/closing control device which has a first shaft end at a lower side and a second shaft end at an upper side.

15. The Venetian blind of claim 1, wherein the first bevel gear of the slat opening/closing control device has an extended member at one edge that has a lower edge blocking member.

16. The Venetian blind of claim 1, wherein the first bevel gear has a barrel on the periphery that has a slot and a gap at the bottom thereof.

17. The Venetian blind of claim 1, wherein the slat opening/closing control device further has the transmission wheel which has a gear formed on the perimeter thereof, a stem extended from an upper side of the transmission wheel which has an aperture formed thereon to couple with the shaft portion of a same diameter, and the adjustment member is coupled to the outer side of the stem.

18. The Venetian blind of claim 1, wherein the transmission set is a transmission wheel coupled with a volute spring.

19. The Venetian blind of claim 1, wherein the slat opening/closing control device is coaxially installed on the transmission set in the space of the upper rail.

20. The Venetian blind of claim 1, wherein the slat opening/closing control device is coaxially installed on the reel set in the space of the upper rail.

* * * * *